United States Patent [19]

Blattner

[11] 4,248,107

[45] Feb. 3, 1981

[54] ADJUSTING TORQUE WRENCH

[75] Inventor: Raymond J. Blattner, Palos Hills, Ill.

[73] Assignee: Dresser Industries, Inc., Dallas, Tex.

[21] Appl. No.: 67,583

[22] Filed: Aug. 17, 1979

[51] Int. Cl.[3] ..... B25D 23/142

[52] U.S. Cl. ..... 81/483

[58] Field of Search ..... 81/52.4 R, 52.5

[56] References Cited

U.S. PATENT DOCUMENTS

| | | | |
|---|---|---|---|
| 2,667,800 | 2/1954 | Garwood | 81/52.4 |
| 2,792,733 | 5/1957 | Walraven et al. | 81/52.4 |
| 2,962,918 | 12/1960 | Van Hoose | 81/52.4 |
| 3,276,296 | 10/1966 | Woods | 81/52.4 |
| 3,355,970 | 12/1967 | Knudsen et al. | 81/52.4 |
| 3,581,606 | 6/1971 | Grabovac | 81/52.4 |

*Primary Examiner*—James L. Jones, Jr.

*Attorney, Agent, or Firm*—R. L. Van Winkle; J. N. Hazelwood

[57] ABSTRACT

An improved adjusting torque wrench includes an adjusting screw that is utilized for the purpose of changing the torque setting of the wrench. The screw has a radial flange thereon having a plurality of circumferentially spaced notches in the outer periphery of the flange. The adjusting screw is fixed to the grip member and rotatable therewith relative to an adjusting nut that is fixed in the lever arm of the wrench. A detent that is movable into and out of the recesses in the adjusting screw is slidably carried by the lever arm so that when engaged in the recesses, the detent prevents relative rotation between the grip member and the lever arm, and thus prevents adjustment of the torque. Also, the detent extends exteriorly of the gripping member so that it can be grasped by the operator of the wrench and moved out of the recesses so that the wrench can be easily adjusted to a new torque setting.

4 Claims, 4 Drawing Figures

ADJUSTING TORQUE WRENCH

BACKGROUND OF THE INVENTION

This invention relates generally to improvements in adjusting torque wrenches. More particularly, but not by way of limitation, this invention relates to an improved locking mechanism that selectively prevents and permits adjustment of the torque that is to be exerted through the wrench.

Wrenches of this general type are clearly illustrated in U.S. Pat. No. 2,792,733 issued May 21, 1957 to G. M. Walraven et al and U.S. Pat. No. 3,581,606 issued June 1, 1971 to Bosko Grabovac. Each of the foregoing patents describes a torque wrench that has a rotatable member for pre-setting the desired torque to be exerted through the wrench. Each also has some means of varying the torque and each includes a "snap-over" mechanism which, upon the torque reaching the pre-selected value, overcomes a spring load to permit the head of the wrench to pivot relative to the lever arm. Such pivotal movement is sensed by the operator and he knows that the desired torque has been exerted on the threaded fastener or the like.

While each of the foregoing devices operates generally satisfactorily, and each includes some means of locking the wrench at the pre-selected torque and unlocking the wrench so that the torque can be varied. Each has certain draw-backs that are overcome by the wrench described in this invention.

In the Walraven et al patent, the tool described therein includes a locking mechanism that is locked and unlocked by the rotation of a lock ring that is part of the grip member. The grip member is grasped by the operator to exert the torque on the wrench. Care must be exercised so that the lock ring is not inadvertently rotated during the exertion of the torque on the wrench or a variation in the pre-selected torque could occur. Also, in the Grabovac patent, the wrench described therein includes a locking mechanism that is an extension of the grip member. Unlocking is accomplished by moving, outwardly of the wrench, a knurled or serrated knob. Again, care must be exerted to be certain that the knob is not inadvertently displaced and rotated during the exertion of torque on the wrench.

This invention provides an improved adjusting torque wrench that includes a locking mechanism that is simple in construction, requires little maintenance and provides positive retention of the pre-selected torque and is not likely to be inadvertently unlocked.

SUMMARY OF THE INVENTION

This invention provides an improved latch mechanism for selectively preventing and permitting adjustment of the torque in an adjusting torque wrench and comprises an adjusting screw located within a lever arm and grip member that is rotatable with a grip member. The screw includes a radial flange portion that has a plurality of circumferentially spaced recesses therein. A latch member slidably carried by the lever arm extends within the grip member, includes a detent portion that is arranged to fit within the recesses, and has an operating portion located outside the grip member whereby the latch member is movable in the arm to place the detent portion in a recess in engagement with the flange portion, preventing rotation of the grip member relative to the arm and when moved out of engagement permitting such relative rotation and adjustment of the preselected torque.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
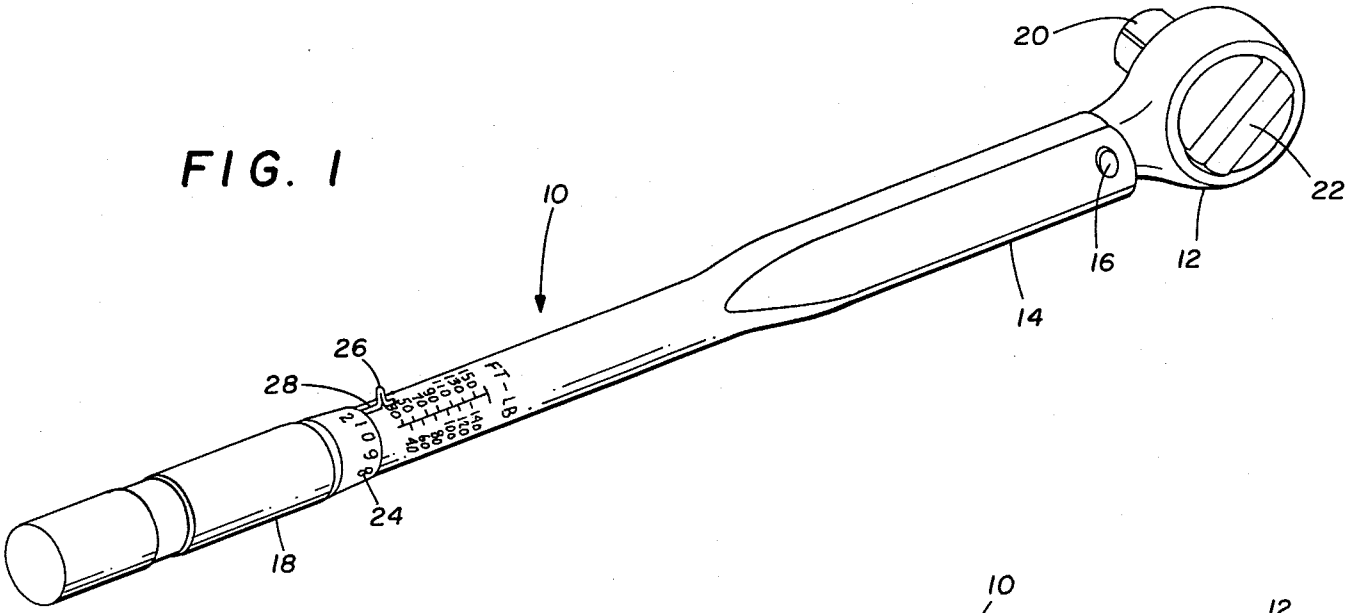
FIG. 1 is a pictorial view of an adjusting torque wrench that is constructed in accordance with the invention.

Referring to the drawing, and to FIG. 1 in particular, shown therein and generally designated by the reference character 10, is an adjusting torque wrench constructed in accordance with the invention. As illustrated, the torque wrench 10 includes a head 12 extending into and pivotally connected to a lever arm 14 by a pivot pin 16. At the opposite end of the lever arm 14, there is provided a grip member 18 which is hollow and extends over a portion of the lever arm 14 as will be described more fully hereinafter. The head 12, as illustrated, is a ratcheting mechanism with a square drive 20 for connection to a socket or the like. The ratchet mechanism includes a reversing lever 22 shown on top of the torque wrench 10.

The torque wrench 10 is of the pre-settable type and a scale in ft/lbs of torque can be seen on the lever arm 14 adjacent to the grip member 18, which is rotatable relative to the lever arm 14. Encircling the grip member 18 adjacent to the ft/lbs scale, is a series of numbers 24. The numbers 24 extend from 0 through 9 and are arranged to line up with the ft/lbs scale to indicate the torque pre-set into the torque wrench 10 to the nearest ft/lb. The operating portion 26 of a latch mechanism 28 serves to positively lock the grip member 18 to the lever arm 14 to prevent rotation therebetween. Upon movement of the latch mechanism 28, as will be described, relative rotation between the grip member 18 and lever arm 14 is permitted. The latch mechanism 20 will be described more completely in connection with FIGS. 2 through 4.

Figure 2:
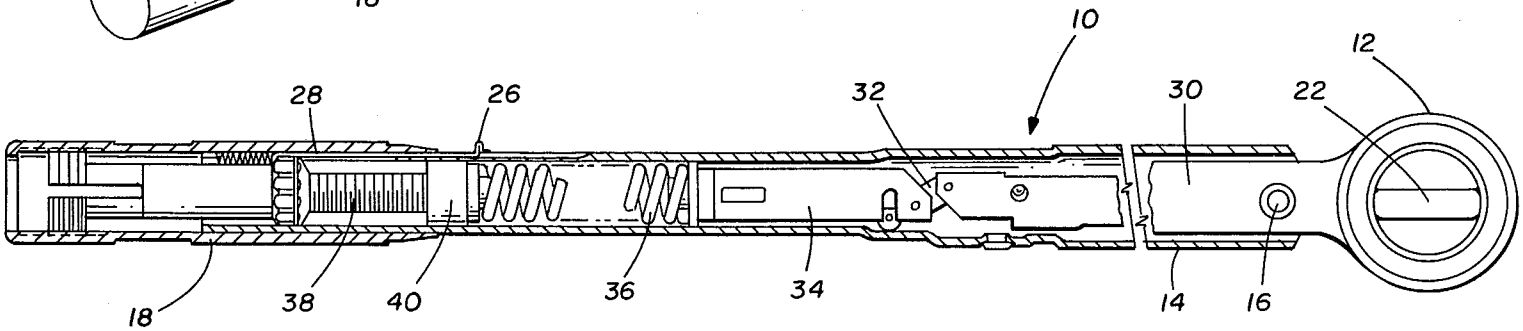
FIG. 2 is a cross-sectional view of the adjusting torque wrench illustrated in FIG. 1.

Referring now to FIG. 2, it can be seen therein that the head 12 includes a shank portion 30 that extends in the interior of the lever arm 14. The shank 30 is connected by means of an offset link 32 with a spring follower member 34.

A compression spring 36 engages the lower end of the member 34 and has its lower end in engagement with a threaded adjusting screw 38. The threaded adjusting screw 38 extends through a threaded nut 40 that is secured to the lever arm 14 by pins 42.

It can be appreciated by viewing FIG. 2 that as the adjusting screw 38 is threaded through the nut 40, a force is exerted on the spring 36 and member 34 so that it requires a greater force to cause the link 32 to pivot. Thus, pivoting of the head 12 about the pivot pin 16 in the lever arm 14 requires a greater torque. As previously mentioned, the pivoting action of the head 12 is an indication to the operator of the torque wrench 10 that the preselected torque has been reached.

Figure 4:
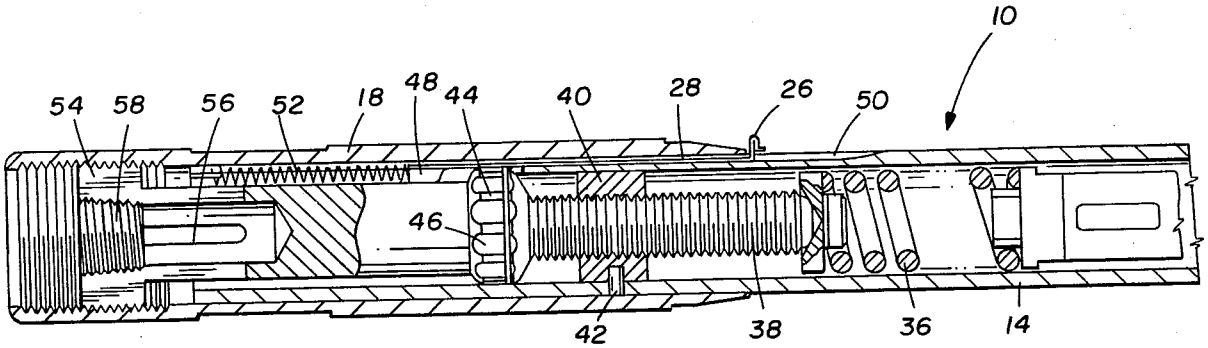
FIG. 4 is a cross-sectional view similar to FIG. 3, but illustrating the wrench parts in different operating positions.
Figure 3:
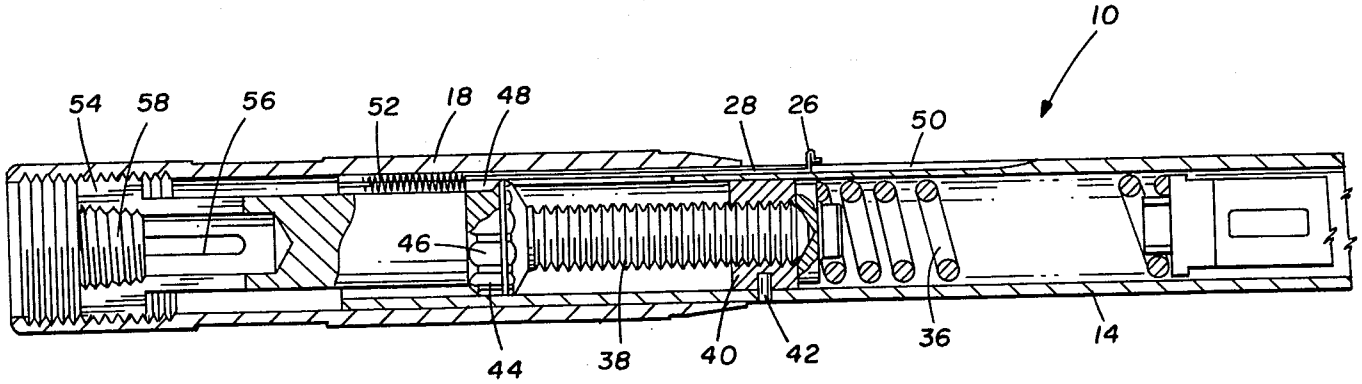
FIG. 3 is an enlarged cross-sectional view of a portion of the torque wrench illustrated in FIGS. 1 and 2 and illustrating in more detail the locking and unlocking mechanism that is also constructed in accordance with the invention.

The enlarged view of FIGS. 3 and 4 illustrates the latch mechanism 28 much more clearly and reference thereto is now made. The threaded adjusting screw 38 includes, near its central portion, a radially extending flange 44 that is provided on its outer periphery with a plurality of circumferentially spaced recesses 46. The recesses 46 are sized and designed to receive a detent portion 48 of the latch mechanism 28.

The detent portion 48 is designed to fit snuggly into one of the recesses 46. The latch mechanism 28 is located in a slot 50 that is formed in the exterior wall of the lever arm 14. A biasing force is exerted on the latch mechanism 28 by a spring 52 that is located within the grip member 18. The spring 52 engages the detent portion 48 to constantly urge the detent portion 48 toward the head 12 of the wrench 10.

The other end of the adjusting screw 38 is provided with a radial flange 54 that is threaded into the grip member 18. The flange 54 has also been slotted as illustrated at 56 and provided with an interior thread which receives an Allen screw 58. When the adjusting screw 38 is placed in the wrench 10, the screw 38 is located in the grip member 18 with the spring 36 compressed sufficiently so that the torque necessary to pivot the head 12 through the links 32 occurs at a known torque value. When this has been accomplished, the wrench 10 is calibrated and the Allen screw 58 is screwed into the end of threaded adjusting screw 38 locking the adjusting screw 38 to the gripping member 18 so that they rotate together.

When it is desired to pre-set a selected torque value into the wrench 10, the operator engages the operating portion 26 of the latch mechanism 28 sliding it towards the grip member 18 until the detent 48 is moved out of the recess 46. When this occurs, the grip member 18 and adjusting screw 38 can be rotated relative to the lever arm 14. Upon rotation, in a direction to feed the adjusting screw 38 toward the wrench head 12, a compressive force is placed into the spring 36 increasing the torque necessary to cause the link 32 to pivot.

Rotation of the grip member 18 relative to the lever arm 14 is continued until the desired torque value is indicated at the ft/lbs scale on the lever arm 14. Once this value has been reached, the latch mechanism 28 is released and the spring 52 drives the detent 48 into the adjacent recess 46 locking the grip member 18, adjusting screw 38 and lever arm 14 together preventing relative rotation. Thus, the desired pre-selected torque is securely locked into the wrench 10 and it cannot be changed until the latch mechanism 28 is manually released.

It should be apparent from the foregoing that torque wrench 10, when constructed as described, provides a simple lock mechanism that is easily incorporated into the wrench and yet provides a positive lock to prevent the inadvertent changing of the pre-selected torque. It is highly unlikely that any operation performed with the wrench would cause the latch mechanism 28 to be inadvertently disengaged, but even if such should occur, rotation of one recess 46 only changes the torque by about 1 ft/lb since the latch mechanism 28 will reengage with the next recess 46 due to the constant biasing force exerted by the spring 52 on the detent 48.

Having described but a single embodiment of the invention, it will be understood that the details presented are by way of example only and that many changes and modifications can be made hereto without departing from the spirit of the invention.

The embodiments of the invention in which an exclusive property or privilege is claimed are defined as follows:

1. In an adjusting torque wrench including a wrench head, a hollow lever arm pivotally connected at one end to the wrench head, a rotatable hollow grip member encircling a portion of the other end the arm, adjustable means within said arm and grip member for preventing pivoting of said head relative to said arm until the torque on said head exceeds a preselected value, and an improved latch mechanism for selectively preventing and permitting adjustment of said torque comprising:

an adjusting screw located within said arm and grip member for rotation therewith, said screw including a radial flange portion having a plurality of circumferentially spaced recesses therein; and a latch member slidably carried by said arm and extending within said grip member, said latch member including a detent portion arranged to fit within said recesses and an operating portion located outside said grip member whereby said latch member is movable in said arm to place said detent portion in engagement with said flange portion preventing rotation of said grip member relative to said arm and movable out of engagement to permit relative rotation and adjustment of said preselected torque.

2. In the torque wrench of claim 1 wherein the improvement also comprises a biasing member engaging said latch member and arm for urging said detent portion into said recesses so that said arm and grip member are not normally rotatable relative to each other.

3. In the torque wrench of claim 2 wherein the detent portion of said latch member is configured to mate closely with said recesses.

4. An improved adjusting torque wrench including a wrench head for receiving a socket wrench or the like, a hollow lever arm pivotally connected thereto, means in said arm preventing pivoting of said head relative to said lever arm until a pre-selected torque is exceeded, and means for adjusting said torque, the improvement comprising:

a hollow grip member encircling a portion of and rotatable with respect to said lever arm;

a torque adjusting screw disposed within said lever arm and connected for rotation with said grip member, said screw including an annular flange portion having circumferentially spaced recesses therein;

an adjusting nut mounted in said lever arm in threaded engagement with said screw;

a latch member carried by and slidable with respect to said lever arm, located within said grip member and including an operating portion projecting outside of said grip member and a detent portion adjacent to said screw whereby said detent portion can be moved into and out of engagement with the flange portion in one of said recesses; and, biasing means urging said latch member in a direction to move said detent portion into one of said recesses for locking said adjusting screw and grip member against relative rotation until said latch member is intentionally repositioned to move said detent portion out of said recesses permitting rotation of said grip member relative to said lever arm and permitting adjustment of the value of the torque necessary to cause pivoting of said head relative to said lever arm.

* * * * *